US006658698B2

(12) United States Patent
Chen

(10) Patent No.: US 6,658,698 B2
(45) Date of Patent: Dec. 9, 2003

(54) HANDLE STRUCTURE FOR SUITCASE OR THE LIKE

(76) Inventor: Wei-Chih Chen, 11F-2, No. 43, Chai-I Street, Taichung City (TW)

( * ) Notice: Subject to any disclaimer, the term of this patent is extended or adjusted under 35 U.S.C. 154(b) by 45 days.

(21) Appl. No.: 09/957,838

(22) Filed: Sep. 24, 2001

(65) Prior Publication Data

US 2003/0057045 A1 Mar. 27, 2003

(51) Int. Cl.[7] ..... A47B 95/02
(52) U.S. Cl. ..... 16/114.1; 16/111.1; 16/406
(58) Field of Search ..... 16/114.1, 111.1, 16/113.1, 706

(56) References Cited

U.S. PATENT DOCUMENTS 2,146,415 A * 2/1939 Bradley ..... 16/411
2,483,307 A * 9/1949 Wheary, Jr. ..... 16/114.1
2,654,115 A * 10/1953 Kafer ..... 16/421
2,913,080 A * 11/1959 Louik et al. ..... 16/408
3,023,868 A * 3/1962 Koffler ..... 16/114.1
3,500,973 A * 3/1970 Bush ..... 16/114.1
3,656,594 A * 4/1972 Marks et al. ..... 16/408
3,692,155 A * 9/1972 Laurita ..... 16/114.1
3,793,674 A * 2/1974 Kneier
4,120,073 A * 10/1978 Studebaker
4,364,150 A * 12/1982 Remington ..... 16/409
5,771,536 A * 6/1998 Sieg et al. ..... 16/431
6,167,592 B1 * 1/2001 Tsai ..... 16/411

* cited by examiner

*Primary Examiner*—Gary Estremsky
*Assistant Examiner*—Mark Williams
(74) *Attorney, Agent, or Firm*—Charles E. Baxley

(57) ABSTRACT

A handle structure includes a body extends through a passage defined in a base of an outer casing. The base has a recess defined in an outer periphery thereof and the passage communicates with the recess. A cap is engaged with the recess by engaging lugs on the cap with the notches in the base.

3 Claims, 3 Drawing Sheets

HANDLE STRUCTURE FOR SUITCASE OR THE LIKE

FIELD OF THE INVENTION

The present invention relates to a handle structure for a suitcase or the like and the handle has a soft casing with an identification member on a top of the casing.

BACKGROUND OF THE INVENTION

A conventional handle for a suitcase or the like generally includes a solid portion with a leather outer sleeve. The conventional handle has only few shape so that the handles of everybody's suitcase are similar. However, the market requires more characterized handles that represent an unique value or taste of the users. Another disadvantage is that because the handles are all similar, so that it is difficult for the users to identify their suitcases among the travelers' luggage.

SUMMARY OF THE INVENTION

In accordance with one aspect of the present invention, there is provided a handle structure which comprises a body received in an outer casing which includes a base and a cap. The base has a recess defined in an outer periphery thereof and a passage is defined through the base. The passage communicates with the recess and the body is received in the passage. The cap is engaged with the recess. A plurality of first engaging devices are located in an inner periphery of the recess of the base and a plurality of second engaging devices are located on the cap and engaged with the first engaging devices.

The primary object of the present invention is to provide a handle structure that provides a removable cap on the base of the handle so as to provide an identification function.

The present invention will become more obvious from the following description when taken in connection with the accompanying drawings which show, for purposes of illustration only, two preferred embodiments in accordance with the present invention.

DETAILED DESCRIPTION OF THE PREFERRED EMBODIMENTS

Figure 1:
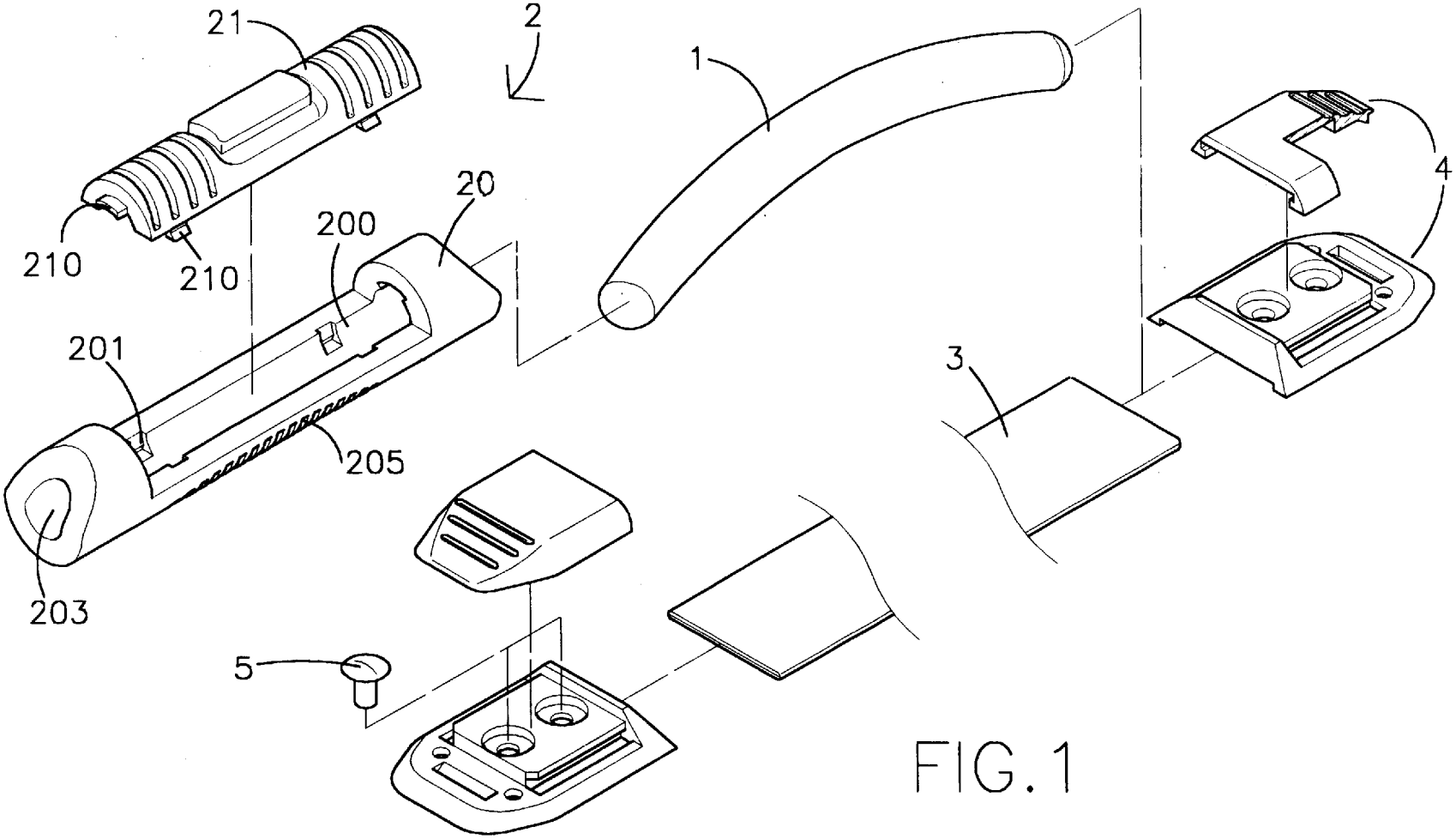
FIG. 1 is an exploded view to show the handle structure of the present invention.
Figures 2, 3:
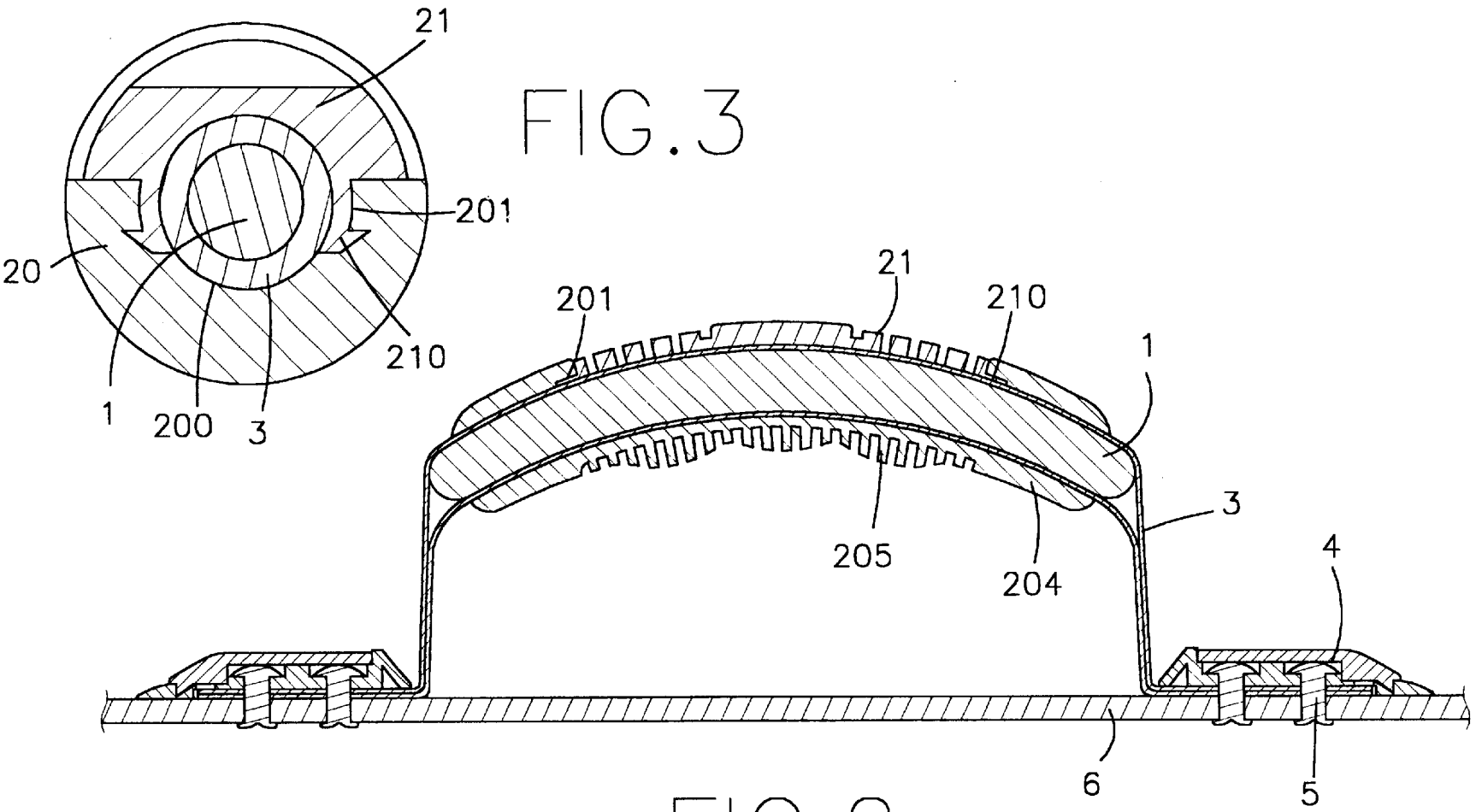
FIG. 2 is a cross sectional view to show the handle structure of the present invention.
FIG. 3 is an end cross sectional view to show the engagement of the handle structure of the present invention.

Referring to FIGS. 1 to 3, the handle structure of the present invention comprises a solid body 1 which is received in an outer casing 2 which is composed of a base 20 and a cap 21. The base 20 has a recess 200 defined in an outer periphery thereof and a passage 203 defined through the base 20. The passage 203 communicates with the recess 200. A sleeve 3 is mounted on the body 1 and the body 1 is received in the passage 203. The two ends of the sleeve 3 are fixed on a suitcase 6 by using rivets 5 and fixing plates 4 on the suitcase 6. A plurality of first engaging devices 201 such as notches are defined in an inner periphery of the recess 200 of the base 20 and a plurality of second engaging devices 210 such as lugs are located on the cap 21. The lugs are engaged with the notches to position the cap 21. A plurality of grooves and ribs 205 are defined in the outer periphery of the base 20 and face the suitcase 6 so that the user's hand may hold the handle comfortably.

Figures 4, 5:
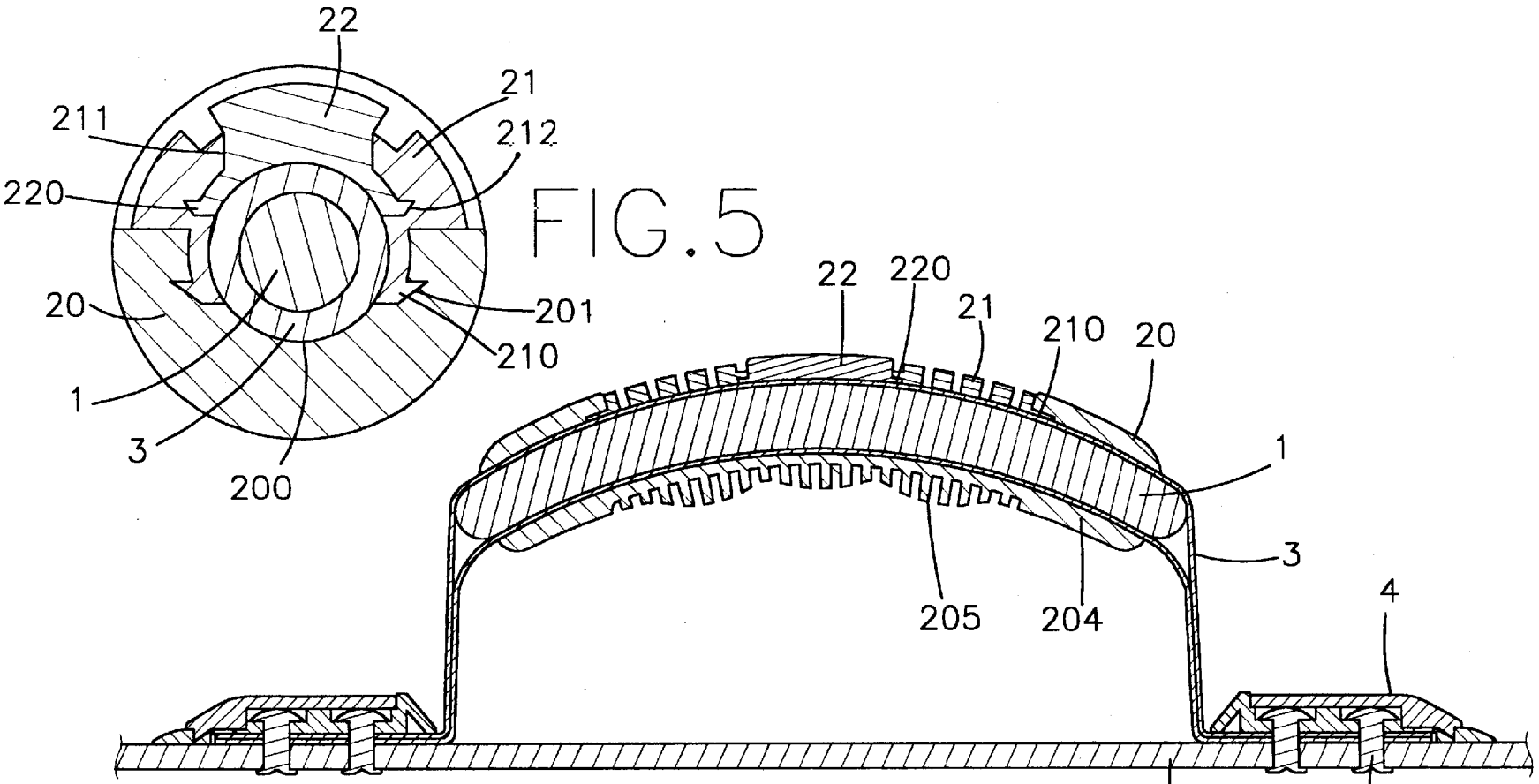
FIG. 4 is a cross sectional view to show another embodiment of the handle structure of the present invention.
FIG. 5 is an end cross sectional view to show the engagement of the handle structure of the present invention as shown in FIG. 4.

FIGS. 4 and 5 show another embodiment of the handle structure wherein an engaging recess 211 is defined in the cap 21 and an identification member 22 engaged with the engaging recess 211. The engaging recess 211 has notches 212 defined in two sides of the inside thereof and the identification member 22 has protrusions 220 extending therefrom, the protrusions 220 are engaged with the notches 212. The identification member 22 has an unique color or shape so that the user can see his/her suitcase among others' luggage.

While we have shown and described the embodiment in accordance with the present invention, it should be clear to those skilled in the art that further embodiments may be made without departing from the scope of the present invention.

What is claimed is:

1. A handle structure comprising:

a tubular body received in an outer casing, said outer casing having a base and a cap, said base having a recess defined in an outer periphery thereof and a passage defined through said base, said passage communicating with said recess and said body received in said passage, a sleeve mounted on said body and two ends of said sleeve adapted to be fixed on a suitcase, said cap engaged with said recess and having an engaging recess defined therein, an identification member engaged with said engaging recess, a plurality of first engaging devices located in an inner periphery of said recess of said base, a plurality of second engaging devices located on said cap and engaged with said first engaging devices.

2. The handle structure as claimed in claim 1, wherein said first engaging devices are notches and said second engaging devices are lugs.

3. The handle structure as claimed in claim 1 further comprising a plurality of grooves defined in said outer periphery of said base.

* * * * *